US008151728B2

(12) United States Patent
Lee et al.

(10) Patent No.: US 8,151,728 B2
(45) Date of Patent: Apr. 10, 2012

(54) GAS WIPING APPARATUS

(75) Inventors: Dong Eun Lee, Pohang (KR); Myung Jong Cho, Pohang (KR); Pan Woo Seon, Pohang (KR); Sang Joon Kim, Pohang (KR)

(73) Assignee: Posco (KR)

( * ) Notice: Subject to any disclaimer, the term of this patent is extended or adjusted under 35 U.S.C. 154(b) by 430 days.

(21) Appl. No.: 12/302,081

(22) PCT Filed: Dec. 19, 2006

(86) PCT No.: PCT/KR2006/005583

§ 371 (c)(1),
(2), (4) Date: Nov. 24, 2008

(87) PCT Pub. No.: WO2007/142396

PCT Pub. Date: Dec. 13, 2007

(65) Prior Publication Data

US 2009/0114149 A1 May 7, 2009

(30) Foreign Application Priority Data

Jun. 5, 2006 (KR) ..... 10-2006-0050417
Jun. 5, 2006 (KR) ..... 10-2006-0050419

(51) Int. Cl.

| | |
|---|---|
| ***A23G 3/00*** | (2006.01) |
| ***B05C 11/00*** | (2006.01) |
| ***B05C 13/00*** | (2006.01) |
| ***B05C 13/02*** | (2006.01) |

(52) U.S. Cl. ..... 118/62; 118/63; 118/21

(58) Field of Classification Search ..... None
See application file for complete search history.

(56) References Cited

U.S. PATENT DOCUMENTS

| | | | | | |
|---|---|---|---|---|---|
| 2,692,644 | A | * | 10/1954 | Murray | 239/266 |
| 4,697,542 | A | * | 10/1987 | Kohler et al. | 118/63 |
| 5,346,551 | A | * | 9/1994 | Pannenbecker et al. | 118/63 |
| 5,683,514 | A | * | 11/1997 | Cox et al. | 118/712 |
| 6,199,301 | B1 | * | 3/2001 | Wallace | 34/623 |

FOREIGN PATENT DOCUMENTS

| | | | | |
|---|---|---|---|---|
| JP | 63149957 | U | | 10/1988 |
| JP | 187152 | U | | 6/1989 |
| JP | 2277754 | A | | 11/1990 |
| JP | 3125058 | U | | 12/1991 |
| JP | 637350 | U | | 5/1994 |
| JP | 9217162 | A | | 8/1997 |
| JP | 2000256817 | A | | 9/2000 |
| JP | 2005248299 | A | | 9/2005 |
| KR | 1019960004774 | B1 | | 4/1996 |
| KR | 1020040110831 | A | | 12/2004 |
| KR | 1020040110831 | | * | 11/2005 |

* cited by examiner

*Primary Examiner* — Dah-Wei Yuan
*Assistant Examiner* — Binu Thomas
(74) *Attorney, Agent, or Firm* — The Webb Law Firm

(57) ABSTRACT

A gas wiping apparatus for use in coating a molten metal onto a steel strip. In the apparatus, a chamber, to which a high pressure gas is supplied, defines a multistage uniform pressure space. A lip support unit is associated with a front of the chamber to allow the high pressure gas to flow therethrough, the lip support unit supporting the apparatus against load. Upper and lower lips are associated with a front of the lip support unit to cooperatively define an outlet. The upper lip adjusts a gap of a gas outlet cooperatively with the lower lip, and can be easily installed in a lip support unit while adjusting the gap of the gas outlet stably. Also, edge over coating (EOC) of the steel strip can be prevented without an additional auxiliary nozzle.

17 Claims, 15 Drawing Sheets

[Fig. 1]
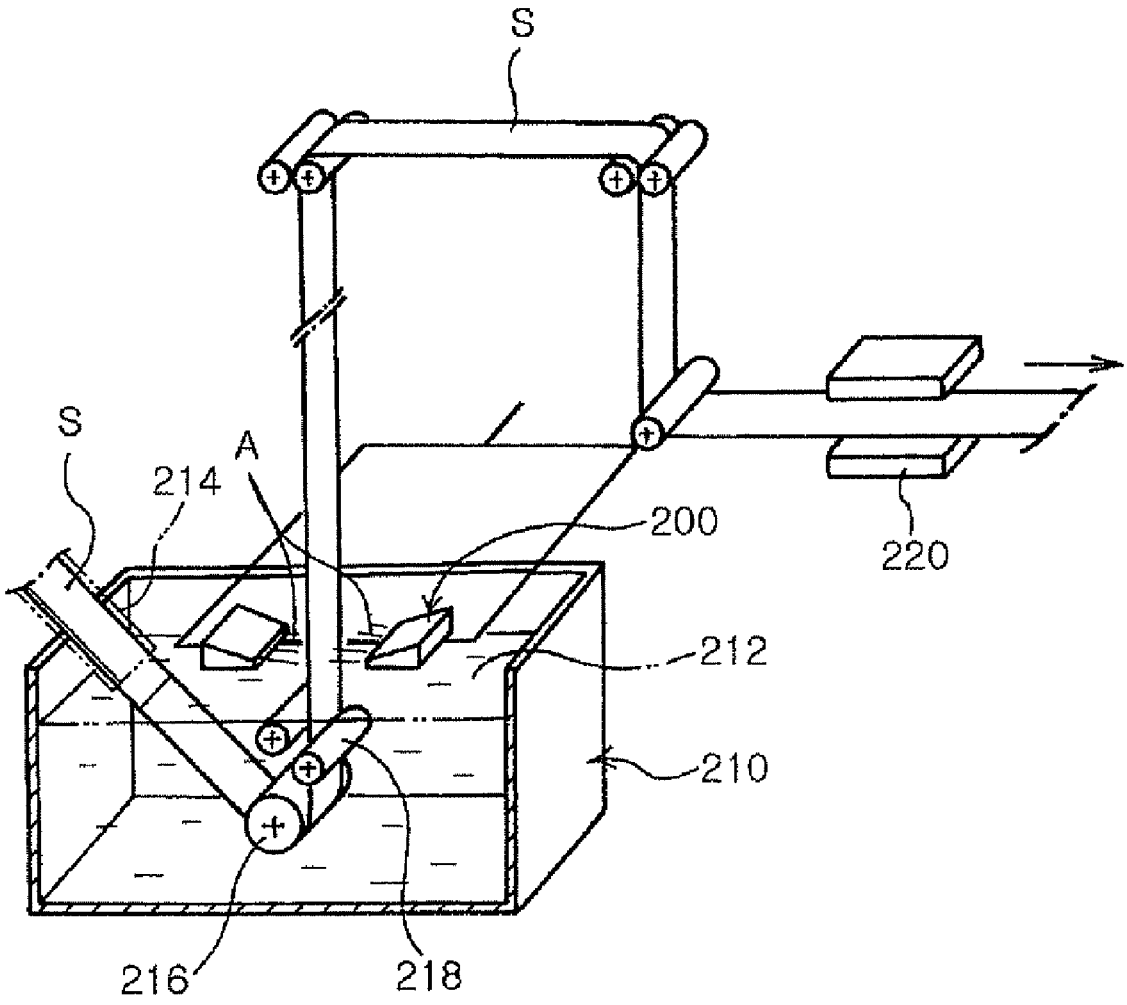
Prior Art

[Fig. 2]
(a)
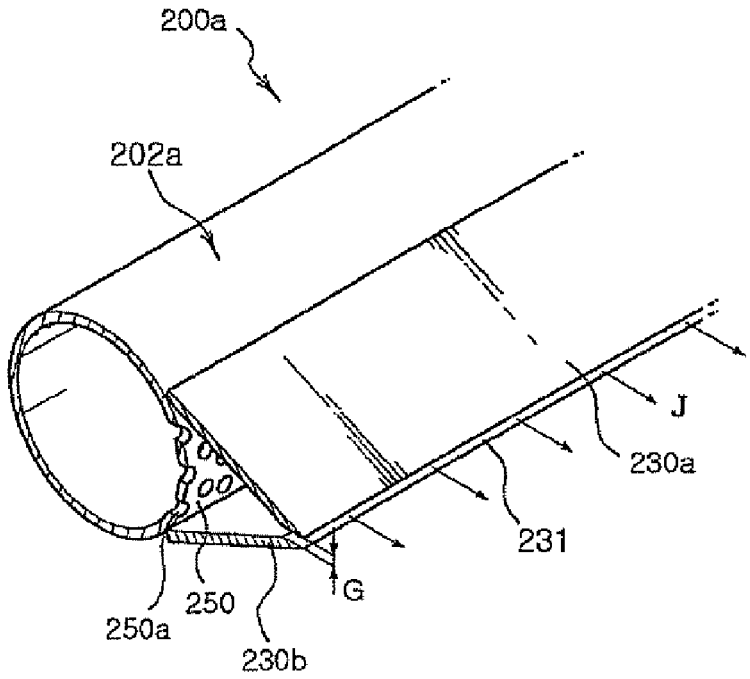
Prior Art
(b)
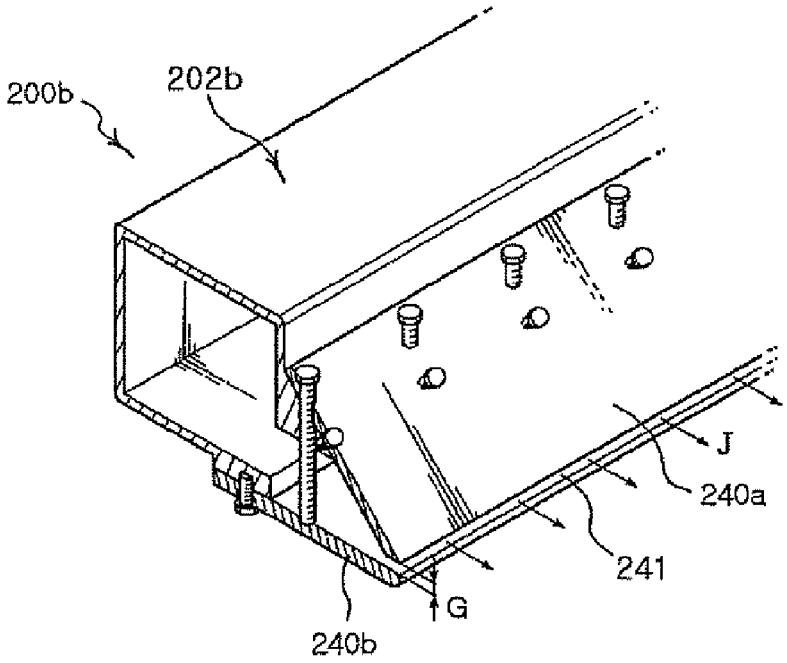
Prior Art

[Fig. 3]
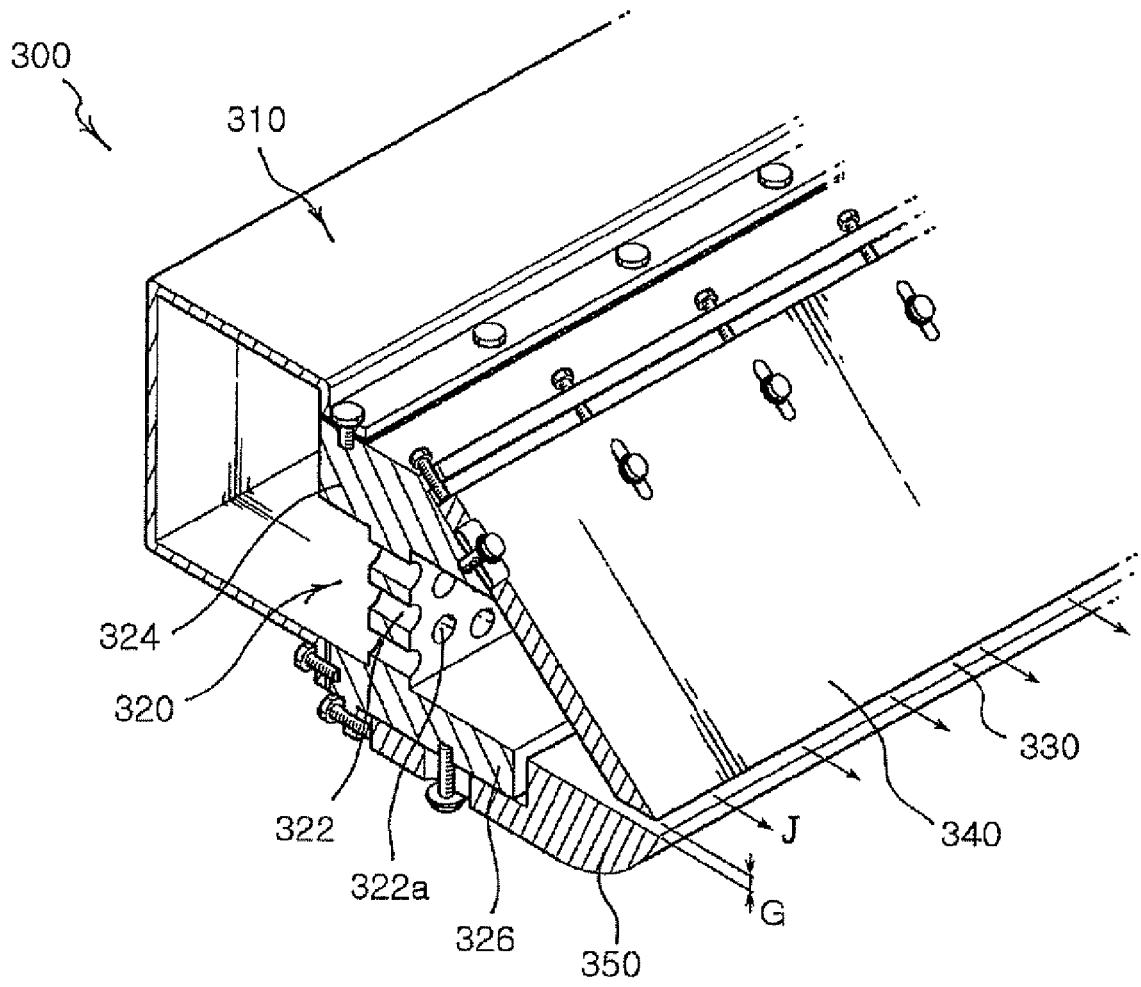
Prior Art

[Fig. 4]
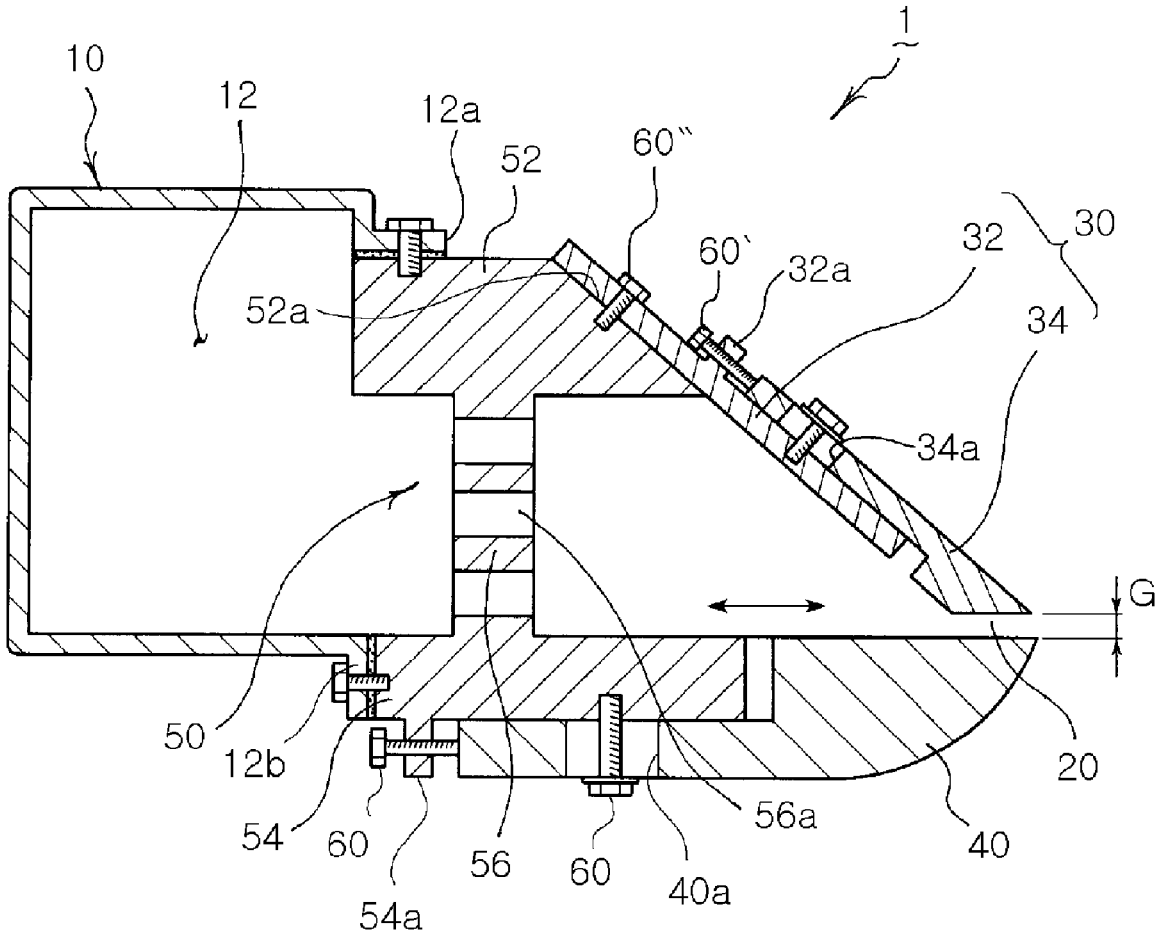

[Fig. 5]
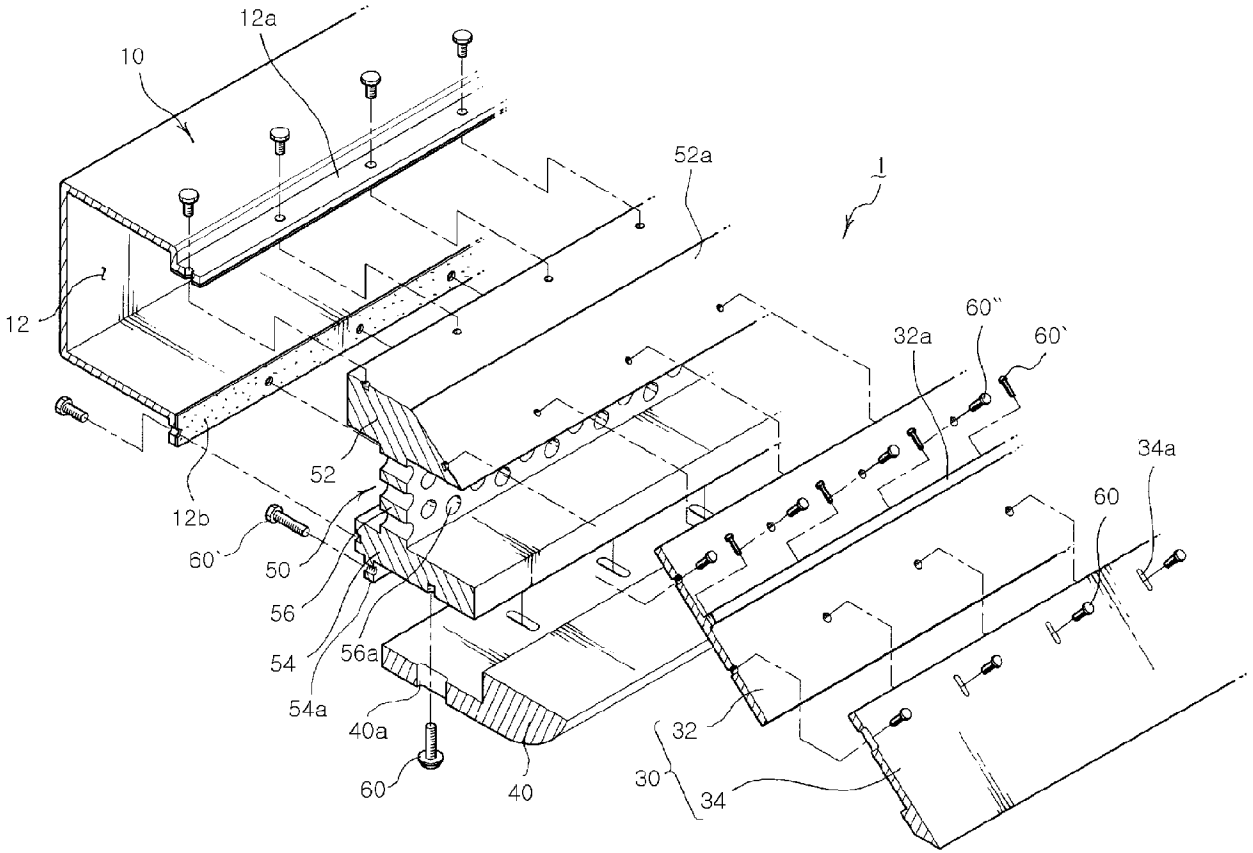
[Fig. 6]
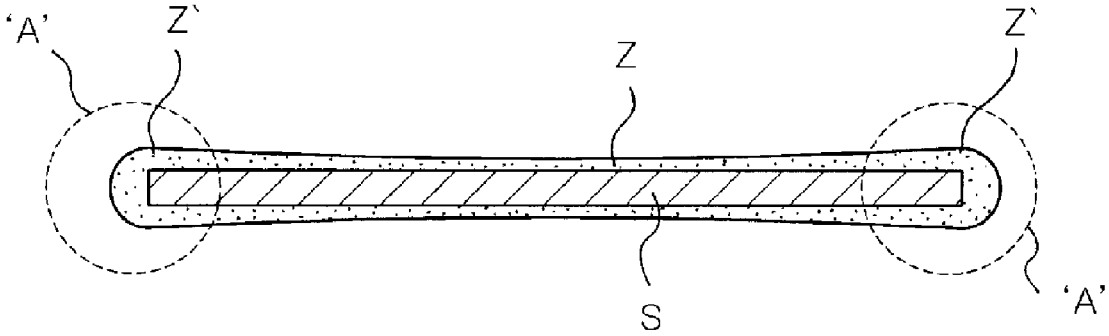

[Fig. 7]
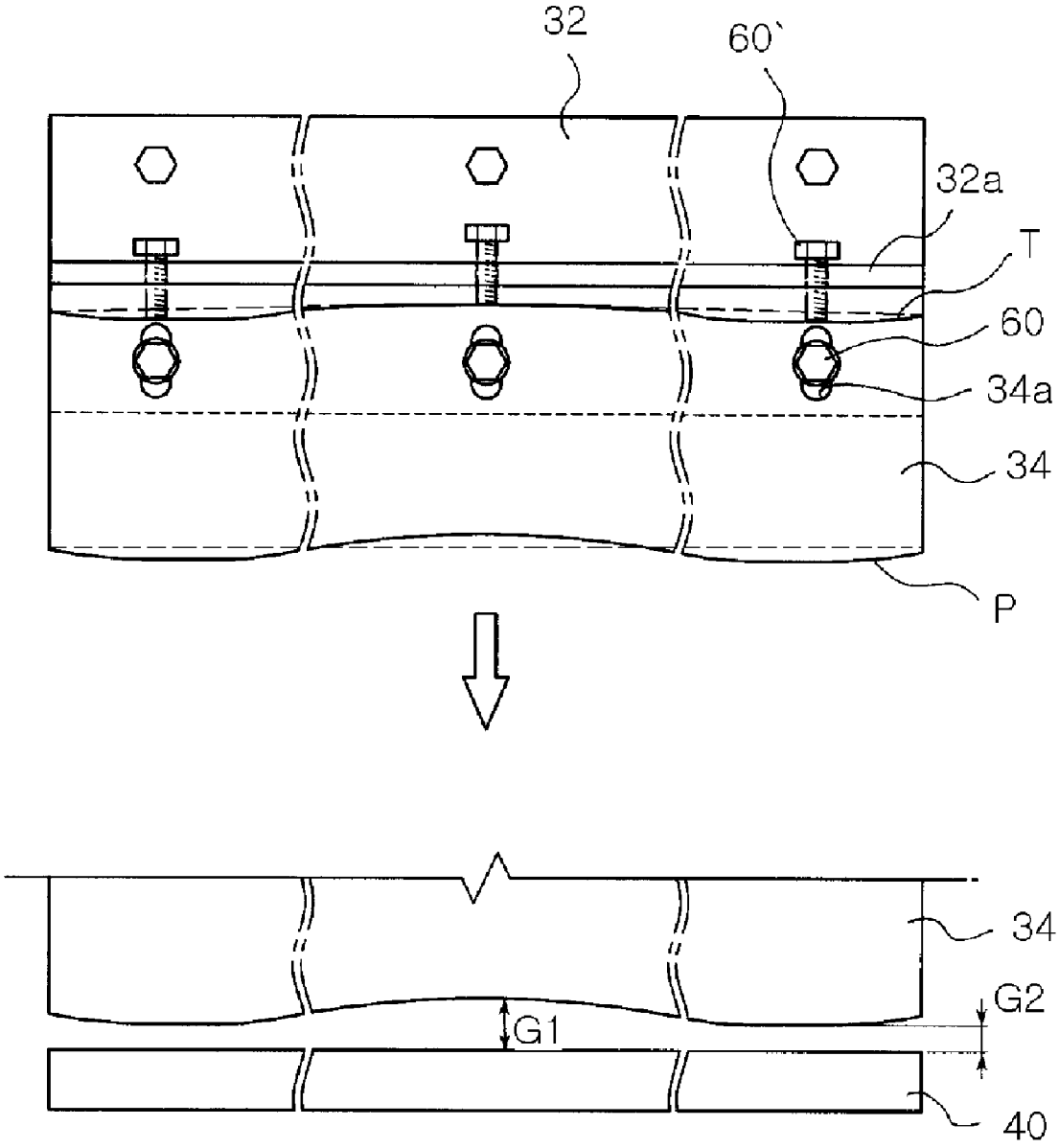

[Fig. 8]
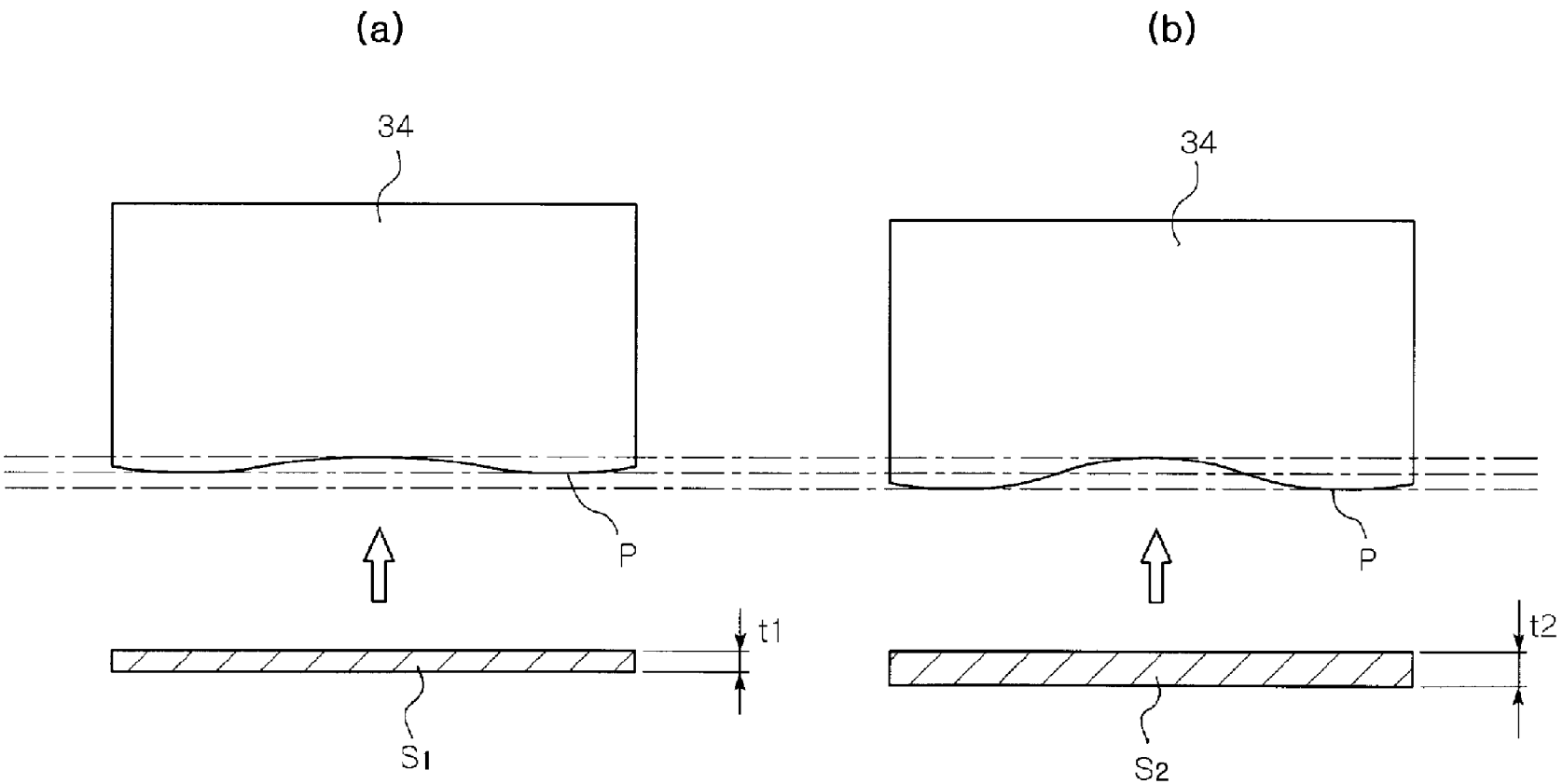

[Fig. 9]
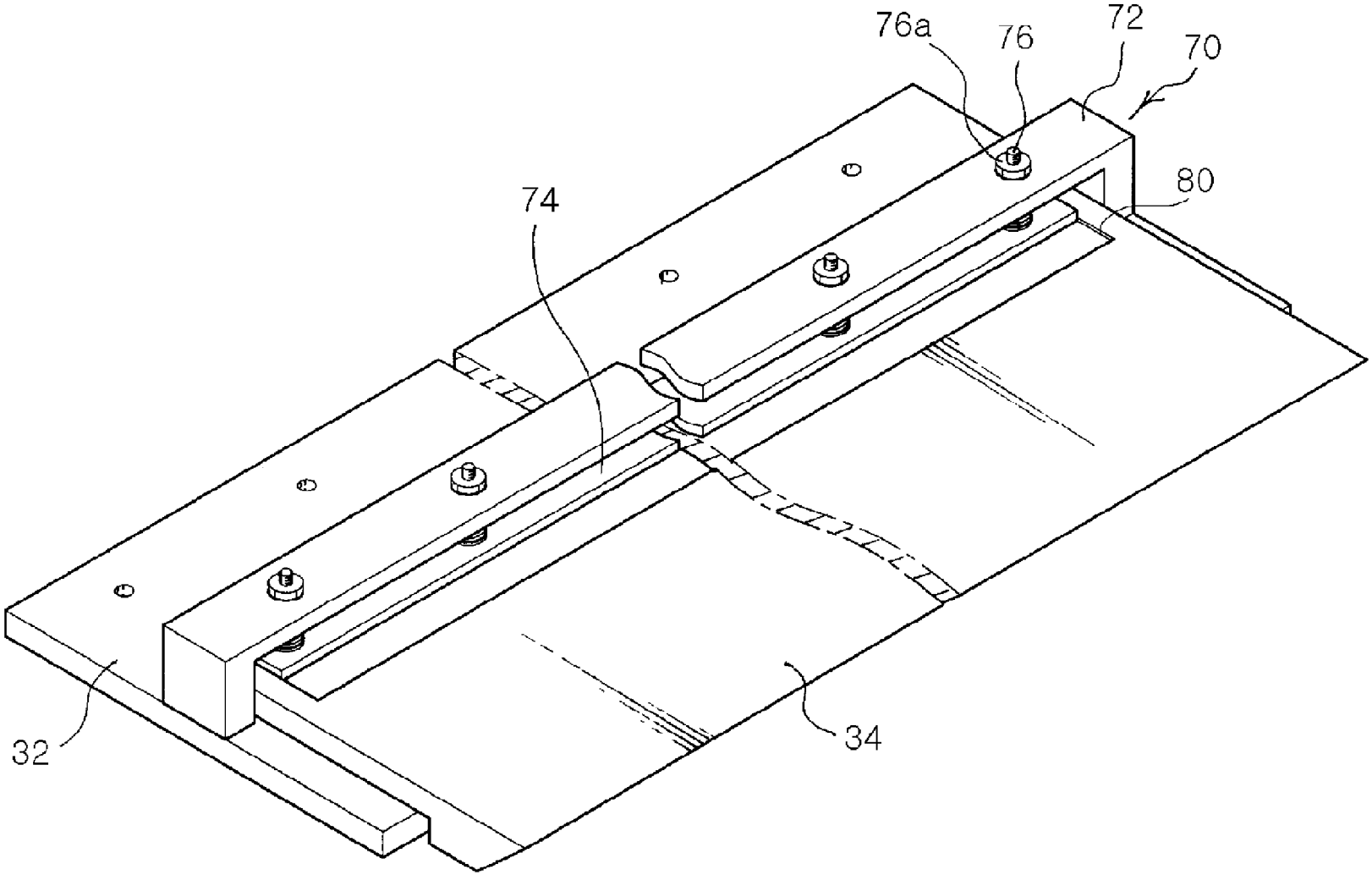

[Fig. 10]
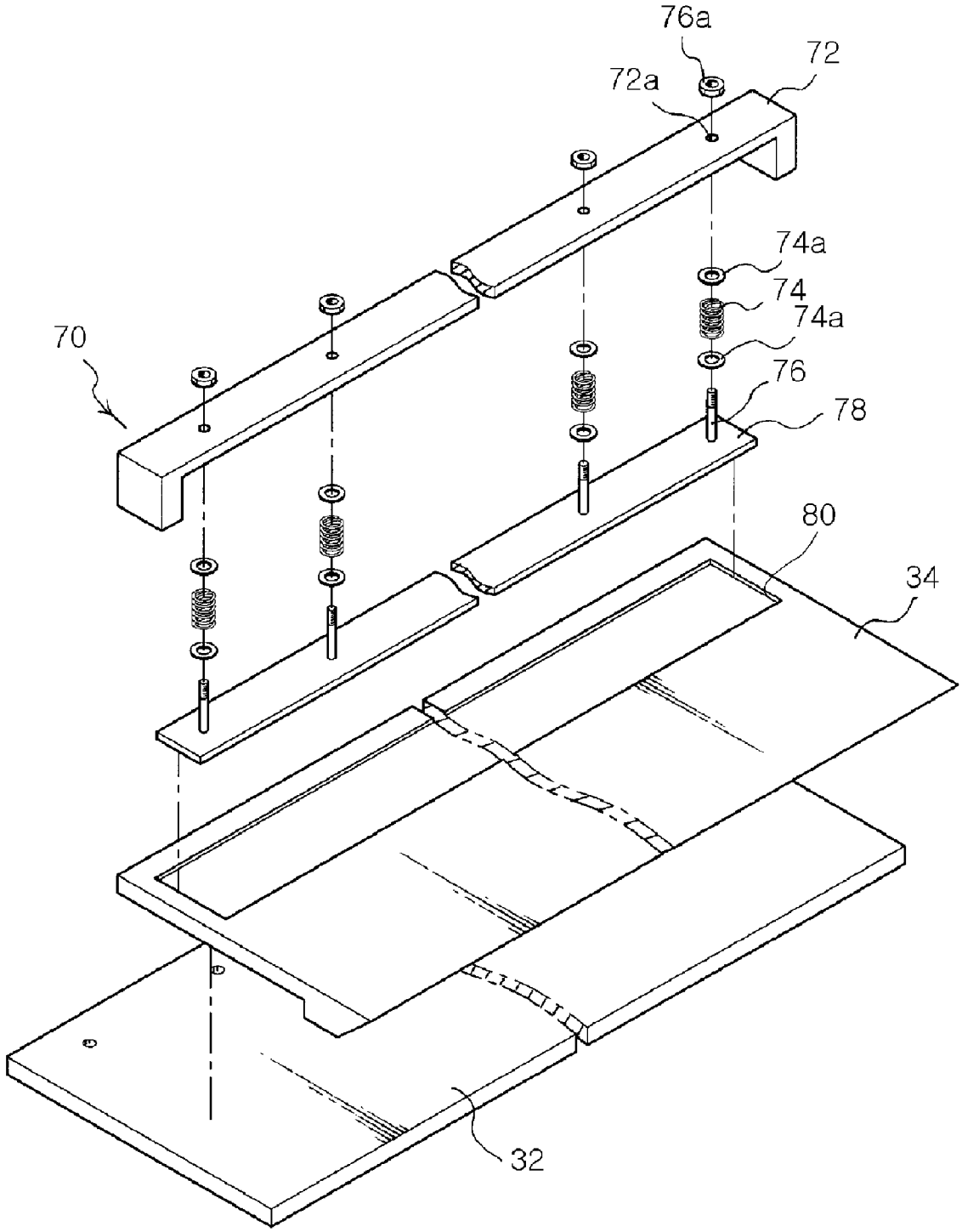

[Fig. 11]
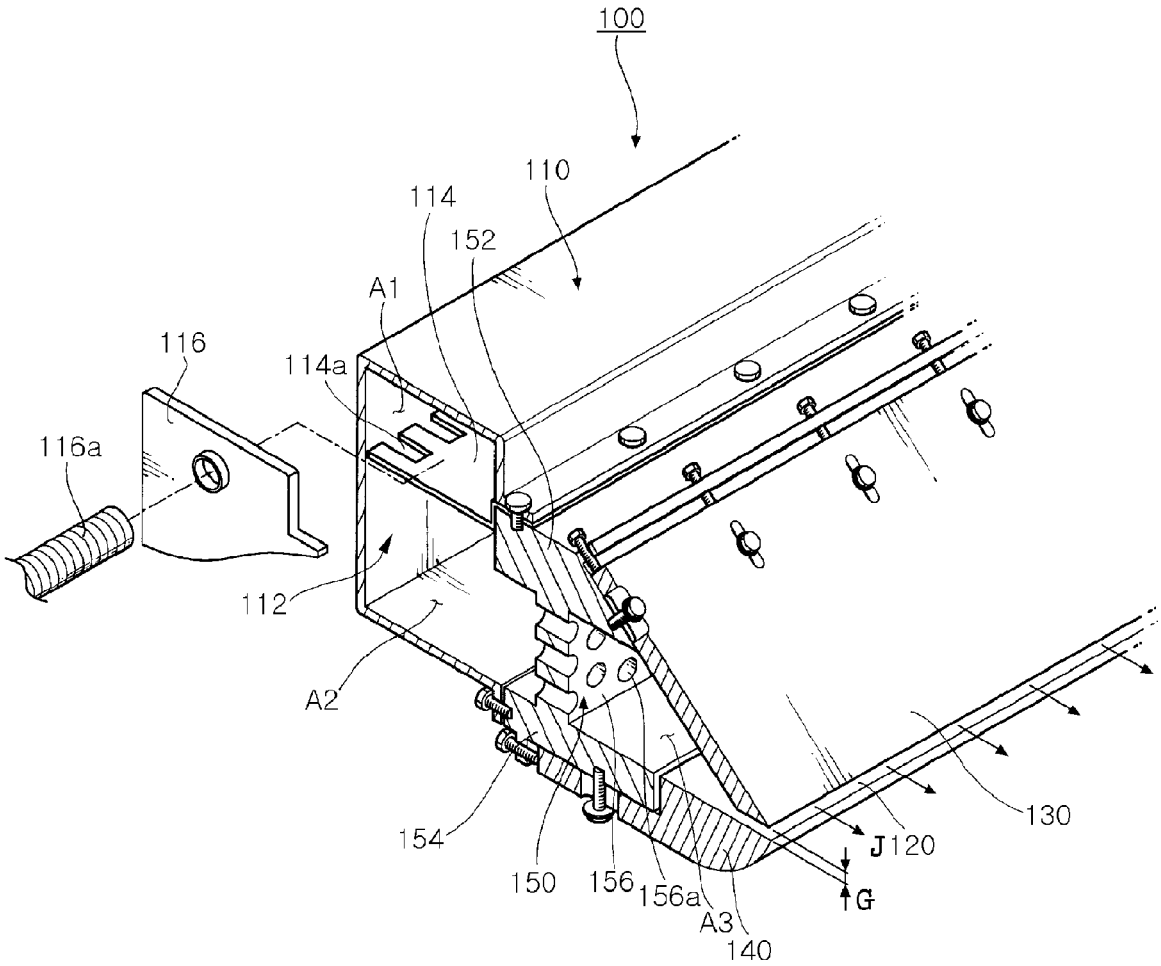

[Fig. 12]
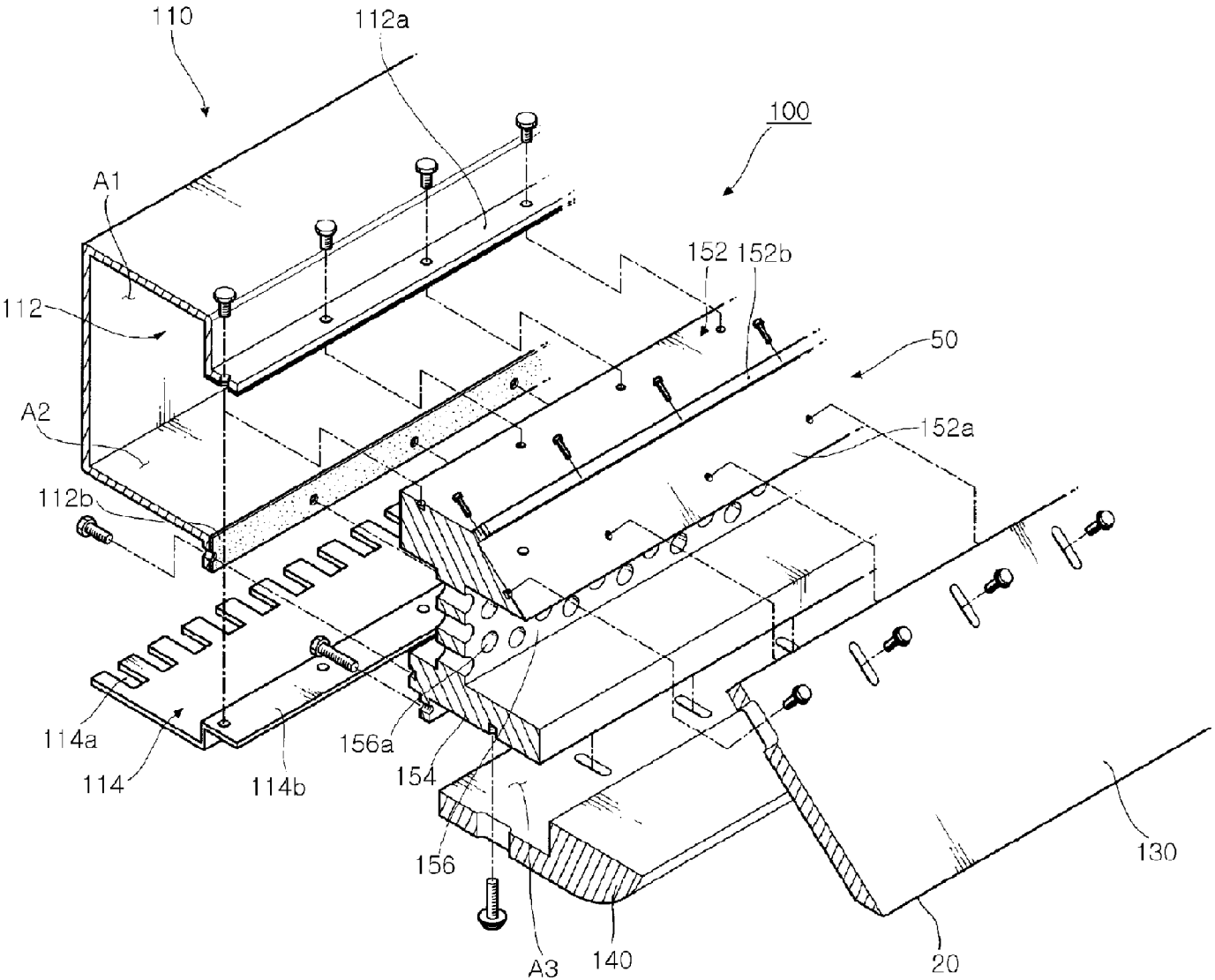

[Fig. 13]
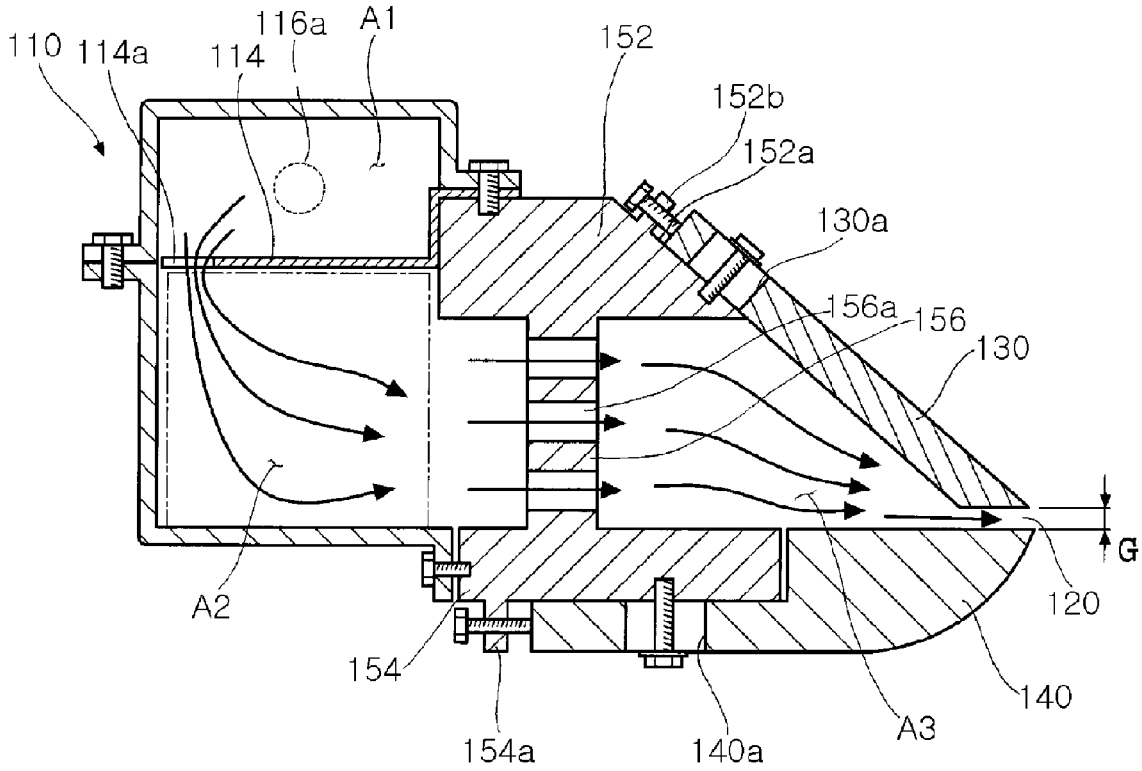
[Fig. 14]
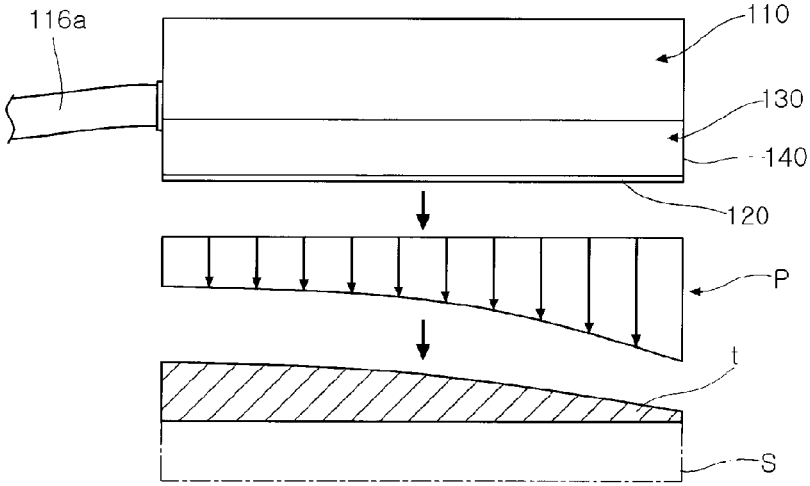

[Fig. 15]
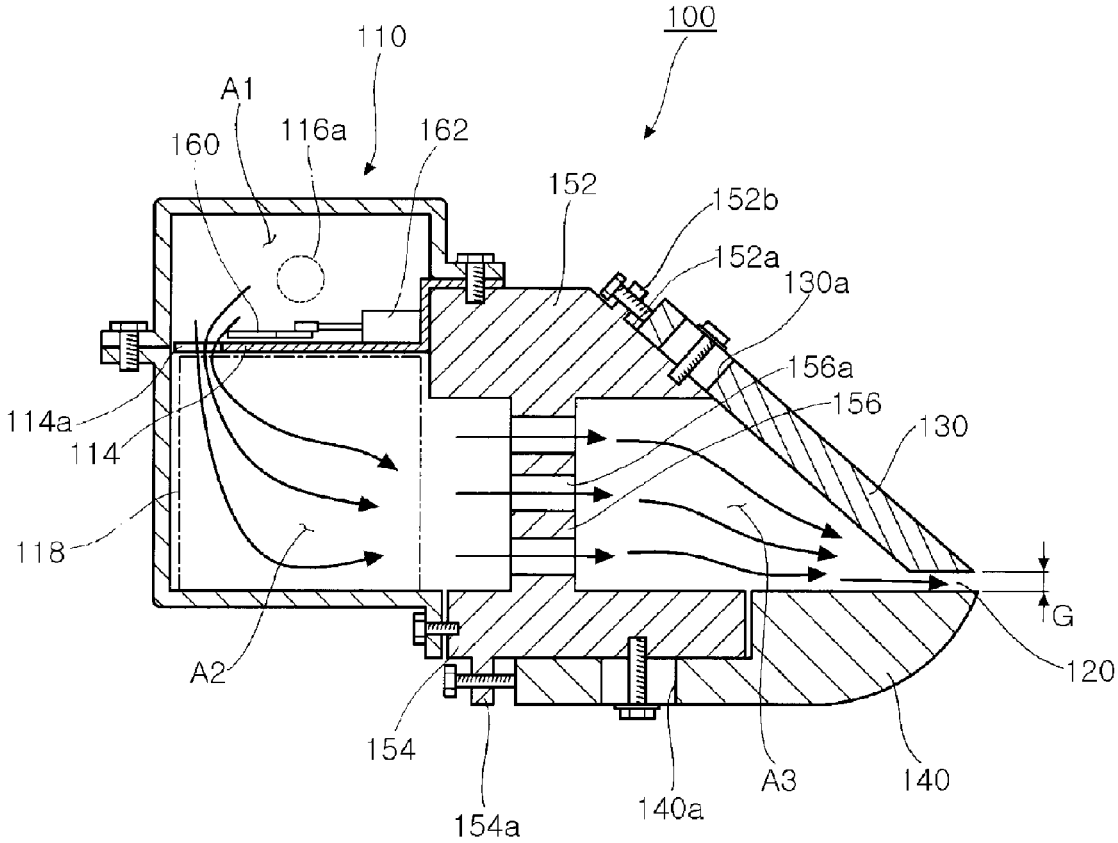
[Fig. 16]
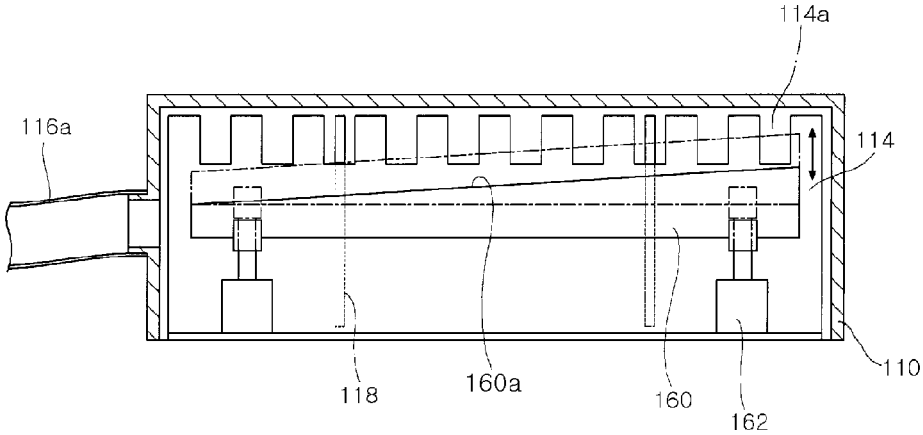

[Fig. 17]
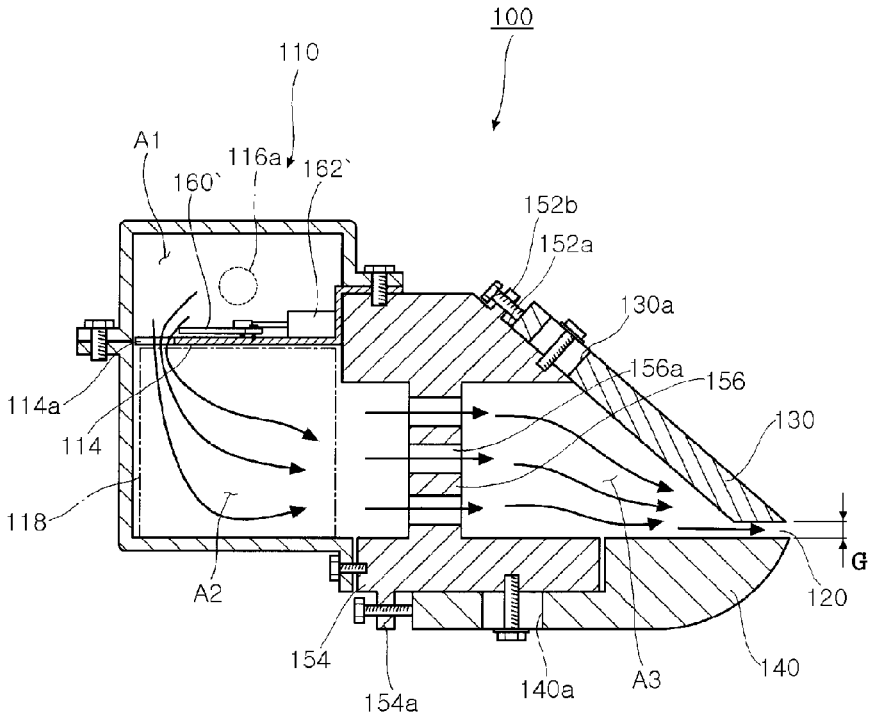
[Fig. 18]
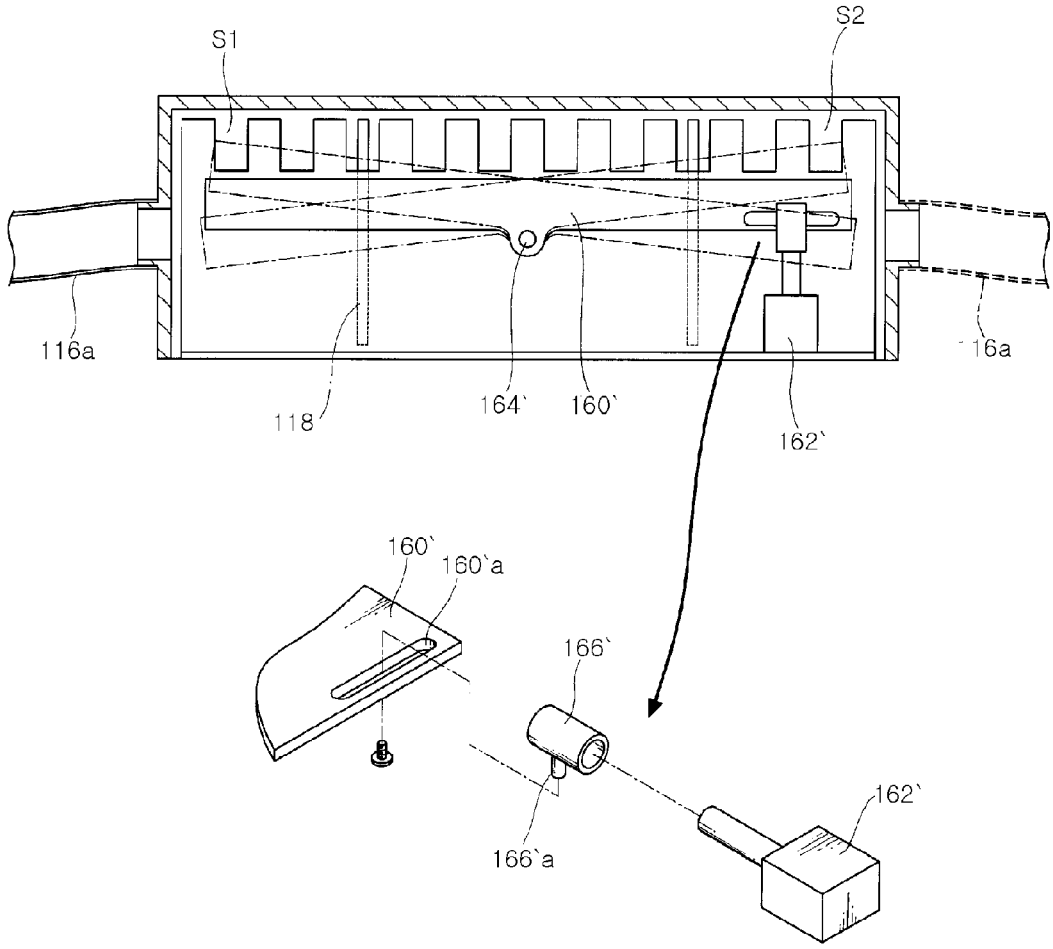

[Fig. 19]
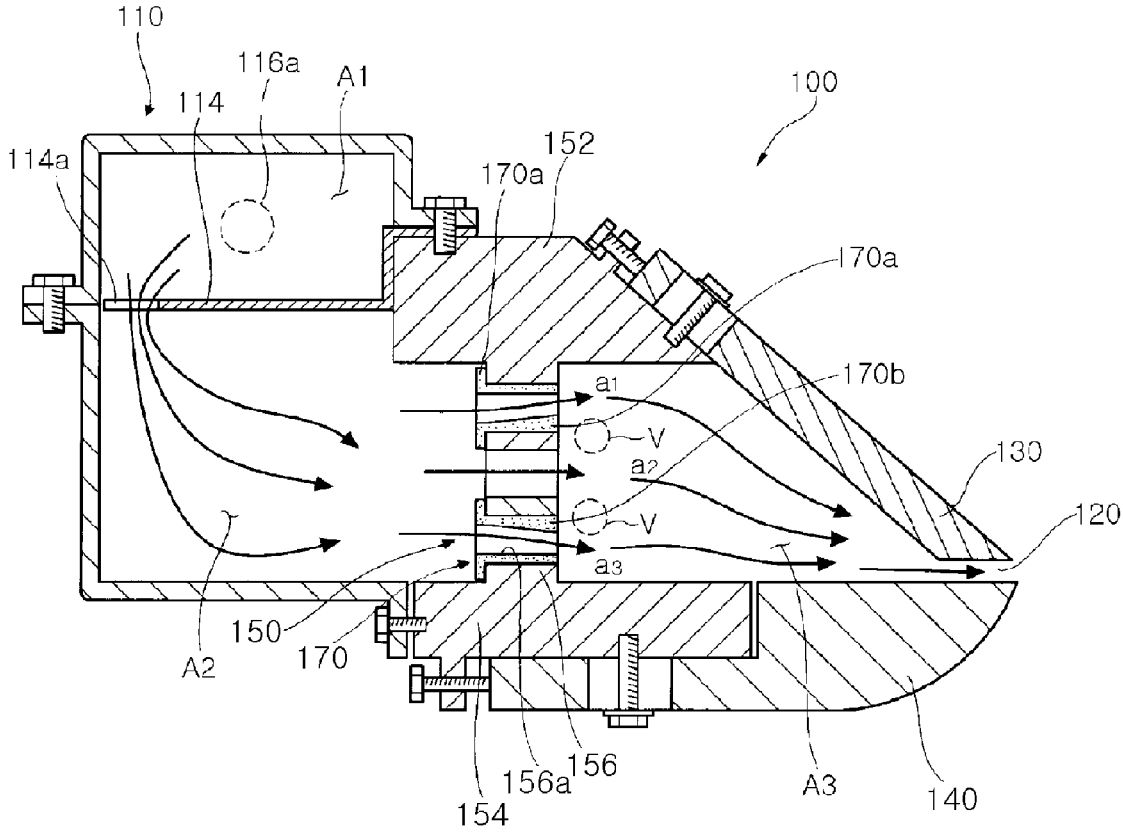
[Fig. 20]
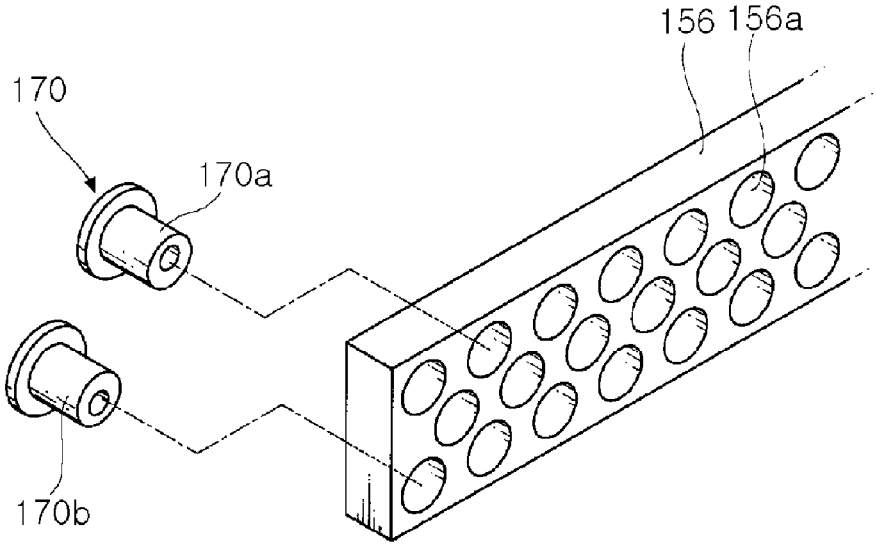

GAS WIPING APPARATUS

TECHNICAL FIELD

The present invention relates to a gas wiping apparatus for coating a molten metal such as molten zinc onto a steel strip.

More particularly, the present invention relates to a gas wiping apparatus in a molten coating line in which an upper lip for adjusting a gap of a gas outlet cooperatively with a lower lip can be easily installed in a lip support unit while adjusting the gap of the gas outlet stably, edge over coating (EOC) of the steel strip is prevented, and also a multistage uniform pressure space is defined by a chamber and the lip to allow a high pressure gas to be ejected uniformly in response to a high pressure gas ejection profile, thereby eventually enhancing coating quality of the steel strip.

BACKGROUND ART

A coated steel strip obtained by coating a specific molten metal, e.g., molten zinc onto a cold-rolled steel strip or a hot-rolled steel strip, is highly corrosion-resistant and has aesthetic appearance.

For example, the steel strip coated with molten zinc has a greater zinc coating amount than an electrically plated steel strip. Thus the coated steel strip is highly corrosion-resistant and low in manufacturing costs. Also, lately the coated steel strip has been widely utilized for inner and outer bodies and an internal structure of automobiles due to superior coating cohesion.

FIG. 1 illustrates a conventional continuous galvanizing line, which is representative of a molten metal coating line.

As shown in FIG. 1, a coil steel strip S uncoiled from a pay off reel is thermally treated in a furnace through a welder and an entry looper. Then the coil steel strip S passes through a hot dipping bath 210 filled with molten zinc 212 through a snout 214 to be coated.

Next, the steel strip passes through a gas wiping apparatus or an air knife 220 disposed over a molten level of the hot dipping bath. In this case, the molten metal solution (zinc) of the steel strip S is adequately worn from the surfaces thereof by a high-pressure air or a non-active gas such as nitrogen, (hereinafter referred to as 'gas', blown onto the steel strip. This allows the steel strip to be adjusted in its coating thickness as shown in A of FIG. 1.

Afterwards, a gauge 220 measures whether the steel strip is coated with an appropriate coating amount. The measured value is fed back to adjust a gas ejection pressure of the gas wiping apparatus 220 and an interval between the steel strip S and the gas wiping apparatus 220, thereby continuously controlling a coating amount of the steel strip.

Here, reference signs 216 and 218 in FIG. 1, which are not described, indicate a sink roll for guiding the steel strip into the hot dipping bath and a stabilizing roll for suppressing vibration of the steel strip.

As described above, the gas wiping apparatus (air knife) 220 is the important equipment for determining a coating thickness of the steel strip to meet consumers' demand.

FIGS. 2(*a*) and (*b*) illustrate examples of a conventional gas wiping apparatus.

As shown in FIGS. 2*a* and 2*b*, the conventional gas wiping apparatus 200*a* and 200*b* includes a cylindrical or box-shaped chamber 202*a* and 202*b*, and upper and lower lips 230*a*, 240*a*, 230*b* and 240*b* joined to a front of the chamber and assembled in pairs in upper and lower parts thereof to form gaps G of gas slits or outlet 231 and 241 to eject the high pressure gas.

The high pressure gas ejected at a high speed onto the steel strip is fed at a high pressure through a feed pipe connected to the chamber, and finally ejected from the gas slit as a high speed jet flow (J of FIG. 2).

Meanwhile, in the gas wiping apparatus, a coating amount of the steel strip is adjusted by a wiping force for the molten metal deposited on surfaces of the steel strip which is submerged in a hot dipping bath (210 of FIG. 1) and then moves along with the molten metal.

As shown in FIG. 2*a*, the conventional gas wiping apparatus 200*a* may have a baffle wall 250 provided with passage holes 250*a* to eject the high pressure gas between upper and lower lips and the chamber in a width direction of the steels strip.

However, in the gas wiping apparatus 200*a* and 200*b* shown in FIGS. 2*a* and 2*b*, the cylindrical or square-shaped chamber supports the gas wiping apparatus against load and is fixedly connected to the upper and lower lips 230*a*, 240*a*, 230*b* and 240*b*, by welding or bolt/nut connections.

Therefore, to sustain strength of the chamber, the large-sized chamber should be sufficiently thick, thereby increasing an overall weight of the gas wiping apparatus. This weakens strength of the upper and lower lips and deforms the gas outlet, i.e., gap G between the upper and lower lips, causing the steel strip to be coated non-uniformly in a width direction of the steel strip.

Korean Patent Laid-open Publication No. 2004-0110831 filed by the same applicant of this application discloses another gas wiping apparatus having an improved structure for solving problems with the aforesaid conventional gas wiping apparatus. FIG. 3 illustrates such a gas wiping apparatus.

As shown in FIG. 3, this conventional gas wiping apparatus 300 includes a chamber 310, a baffle wall 322, a lip support unit 320 and upper and lower lips 340 and 350. The baffle wall 322 is fixedly associated with the chamber 310 and provided with passage holes 322*a* therein. The lip support unit 320 includes upper and lower lip support units 324 and 326 and has a predetermined thickness to sustain strength of the apparatus. The upper and lower lips 340 and 350 are fixedly connected to the lip support unit 320 to form a gas outlet, i.e., gap G.

Therefore, in the conventional gas wiping apparatus 300, the lip support unit 320 serves to support the apparatus against load. Also, the support unit 320 is fixed, at a front side, to the chamber with a smaller thickness and, at a rear side, to upper and lower lips in order to easily sustain strength of the apparatus.

However, in this gas wiping apparatus 300, the upper lip fixed to the lip support unit to adjust the gas outlet is very large-sized. Thus it is very difficult to install the upper lip in the lip support unit or adjust a gap between the upper and lower lips.

Especially, the gap is hardly formed in a gradient fashion in the conventional gas wiping apparatus 200 in order to prevent edge over coating (EOC) of the steel strip.

Moreover, the conventional gas wiping apparatus 300 is not designed in response to an ejection profile of a high-pressure gas fed to the chamber through a feed pipe.

Also, the chamber is not provided with a multistage uniform pressure space where the high pressure gas flows.

This has led the applicant to suggest an improved gas wiping apparatus.

SUMMARY OF THE INVENTION

The present invention has been made to solve the foregoing problems of the prior art and therefore an aspect of the present invention is to provide a gas wiping apparatus in a molten metal coating line, in which an upper lip for adjusting a gap of a gas outlet cooperatively with a lower lip can be easily installed in a lip support unit while adjusting the gap of the gas outlet stably, edge over coating (EOC) of a steel strip is prevented without an additional auxiliary nozzle, a multistage uniform pressure space is defined by a chamber and a lip to allow a high-pressure gas to be ejected uniformly in response to a high pressure gas ejection profile, eventually enhancing coating quality of the steel strip.

According to an aspect of the invention, the gas wiping apparatus includes a chamber to which a high pressure gas is supplied, the chamber defining a multistage uniform pressure space; a lip support unit associated with a front of the chamber to allow the high pressure gas to flow therethrough, the lip support unit supporting the apparatus against load; and upper and lower lips associated with a front of the lip support unit to cooperatively define an outlet.

According to another aspect of the invention, the gas wiping apparatus includes a chamber to which a high pressure gas is supplied; a lip support unit associated with a front of the chamber to allow the high pressure gas to flow therethrough, the lip support unit supporting the apparatus against load; and, upper and lower lips associated with a front of the lip support unit to cooperatively define an outlet, wherein the upper lip includes multiple upper lips linked with the lip support unit.

According to still another aspect of the invention, the gas wiping apparatus includes a chamber to which a high pressure gas is supplied, the chamber defining a multistage uniform pressure space; a lip support unit associated with a front of the chamber to allow the high pressure gas to flow therethrough, the lip support unit supporting the apparatus against load; and, upper and lower lips associated with a front of the lip support unit to cooperatively define an outlet, wherein the upper lip includes multiple upper lips linked with the lip support unit.

The gas wiping apparatus in a molten metal coating line of the invention provides various effects as described below.

First, the upper lip for adjusting a gap of the gas outlet cooperatively with the lower lip is easily installed in a lip support unit while adjusting the gap of the gas outlet stably. That is, the gas outlet is adjustable more precisely.

Notably, this effectively prevents edge over coating of the steel strip.

Moreover, a multistage uniform pressure space is defined by the chamber and the lip, and the high pressure gas ejection profile is adjusted in response to a connection between the chamber and the feed pipe, thereby ensuring the high pressure gas to be ejected more uniformly.

In the end, the gas wiping apparatus of the invention prevents the steel strip from being coated non-uniformly in a width direction and eventually enhances coating quality of the steel strip.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view illustrating a general zinc galvanizing process as an example for coating a steel strip with a molten metal;

FIGS. 2*a* and 2*b* are perspective views illustrating conventional gas wiping apparatuses;

FIG. 3 is a perspective view illustrating another conventional gas wiping apparatus using a lip support unit;

FIG. 4 is an overall configuration view illustrating a gas wiping apparatus according to a first embodiment of the invention;

FIG. 5 is an exploded perspective view of FIG. 4;

FIG. 6 is a schematic view illustrating edge over coating of a steel strip;

FIG. 7 is a view illustrating a second upper lip installed in the gas wiping apparatus according to the invention to form a gradient fashion in a length direction;

FIGS. 8*a* and 8*b* are schematic views illustrating an example of using a second upper lip of a multiple upper lip, which is previously manufactured in a gradient fashion in accordance with a thickness and coating amount of a steel strip in a gas wiping apparatus of the invention;

FIG. 9 is a perspective view illustrating a compressor for enabling easy movement of the second upper lip of a multiple upper lip in a gas wiping apparatus according to the invention;

FIG. 10 is an exploded perspective view of FIG. 9;

FIG. 11 is a perspective view illustrating a gas wiping apparatus according to a second embodiment of the invention;

FIG. 12 is an exploded perspective view of FIG. 11;

FIG. 13 is a side structural view of FIG. 11;

FIG. 14 is a schematic view illustrating a high pressure gas ejection profile and coating amount in a case where a feed pipe is connected to only one side of a chamber;

FIG. 15 is a side structural view illustrating an example of a gas wiping apparatus in response to a high pressure gas ejection profile according to the second embodiment of the invention;

FIG. 16 is a plan view illustrating operation of the gas wiping apparatus of FIG. 15;

FIG. 17 is a side structural view illustrating another example of the gas wiping apparatus of FIG. 15;

FIG. 18 is a plan view illustrating operation of the gas wiping apparatus of FIG. 17;

FIG. 19 is a side structural view illustrating still another example of the gas wiping apparatus according to the second embodiment of the invention, in which a lip support unit has a baffle wall provided with different high-pressure passage holes; and FIG. 20 is a perspective view illustrating an inner diameter reduction tube inserted into the passage holes of the baffle wall of FIG. 19.

BEST MODE FOR CARRYING OUT THE INVENTION

Exemplary embodiments of the present invention will now be described in detail with reference to the accompanying drawings.

With reference to FIGS. 4 to 10, a gas wiping apparatus will be described according to a first embodiment of the invention, and with reference to FIGS. 11 to 20, the gas wiping apparatus will be described according to a second embodiment of the invention. The same components will be denoted with reference numerals in 1× and 10×.

First, the gas wiping apparatus 1 will be described according to a first embodiment of the invention.

FIGS. 4 and 5 are a structural view and an exploded perspective view illustrating the gas wiping apparatus 1 according to the first embodiment of the invention.

That is, as shown in FIGS. 4 and 5, the gas wiping apparatus 1 includes a chamber 10, a multiple upper lip 30 and a lower lip 40. The chamber 10 has a space 12 for containing a high pressure gas (air or inactive gas) supplied. The multiple upper lip 30 is joined to the chamber 10. The lower lip 40 is associated with the chamber 10 and defines a gas outlet 20 with a predetermined gap cooperatively with the multiple upper lip 30.

The gas wiping apparatus 1 of the invention adopts the multiple upper lip 30 in place of the upper lip of the conventional gas wiping apparatus 300 shown in FIG. 3. This allows easier adjustment of the gas outlet 20, i.e., G a gap between the upper and lower lips which practically serves to adjust a coating amount.

The gas wiping apparatus 1 of the invention includes the chamber 10, the multiple upper lip 30 and the lower lip 40 fixedly connected with one another. Also, the gas wiping apparatus 1 includes a lip support unit 50 which allows the high pressure gas to flow therethrough and sustains strength of the apparatus.

As shown in FIG. 5, the lip support unit 50 includes an upper support unit 52, a lower support unit 54 and a baffle wall 56. The upper support unit 52 is fixed, at one end, to an upper end 12*a* of the chamber and, at another end, to a first upper lip 32 of the multiple upper lip 30. The lower support unit 54 is provided, at one end, with a lower end 12*b* of the chamber and, at the other end, with the lower lip 40. The baffle wall 56 is formed integral between the upper and lower support units and provided with passage holes 56*a*.

Therefore, the high-pressure gas supplied flows through the passage holes 56*a* of the lip support unit 50 from an inner space 12 of the chamber. Then, the high-pressure gas is ejected uniformly to both surfaces of a steel strip in a width direction through the gas outlet 20 defined by a gap (G) between distal ends of the multiple upper lip 30 and the lower lip 40.

The baffle wall 56 of the lip support unit 50 enables the high pressure gas fed from the chamber to flow uniformly and thus to be ejected uniformly through the gas outlet 20.

Especially, in the gas wiping apparatus of the invention, the lip support unit 50 serves as a backbone of the apparatus, precluding a need for the chamber fixed thereto to maintain certain strength. This ensures easier manufacturing of the apparatus or reduces an overall weight thereof.

As described in detail later, the lip support unit 50 includes a slanted support surface 52*a* for slantedly fixing a first upper lip 32 of the multiple upper lip 30 thereto.

Meanwhile, as shown in FIGS. 4 and 5, the multiple upper lip 30 includes the first upper lip 32 and a second upper lip 34. The first upper lip 32 is fixed to the upper support unit 52 of the lip support unit 50. The second upper lip 34 is movably disposed in surface contact with the first upper lip 32 and defines the gas outlet 20 together with the lower lip.

Therefore, compared with the conventional upper lip 340 of FIG. 3, in the gas wiping apparatus of the invention, the gas outlet 20 is more easily adjustable in its gap G by using only the second upper lip 34 which is reduced in size.

The first upper lip 32 of the multiple upper lip 30 is fixedly installed on the slanted surface 52*a* of the upper support unit 52 by bolts 60" screwed onto the slanted surface 52*a*. The second upper lip 34, which is movably installed on the first upper lip 32 is integrally provided with a plurality of slits 34*a* through which vertical bolts 60 are screwed to the first upper lip 32.

Therefore, the second upper lip 34 may be installed movable on the first upper lip corresponding to a length of the slits 34*a*, by operating the vertical bolts.

That is, the first upper lip 32 of the invention serves as a guide plate in operating the second upper lip to move.

Also, the first upper lip 32 is integrally provided thereon with a protrusion 32*a* to which horizontal bolts 60' are screwed to compress a rear end of the second upper lip 34.

As a result, in order to adjust the gap G of the gas outlet in the gas wiping apparatus of the invention, first, the vertical bolts 60 are slightly loosened to enable the second upper lip 34 to be movable. Then, the horizontal bolts 60' horizontally screwed to the protrusion of the first upper lip are tightened to compress the rear end of the second upper lip. Accordingly, the second upper lip downwardly moves along the first upper lip, and the vertical bolts 60 are fastened to adjust the gap G between the first upper lip 32 and the lower lip 40.

The lower lip 40 of the invention is also provided with slits 40*a* in the same manner as the second upper lip 34 and movably installed on the lower support unit by the vertical bolts 60 and the horizontal bolts 60'. Here, the vertical bolts 60 are screwed through the slits 40*a* to the lower support unit 54 of the lip support unit. The horizontal bolts 60' are screwed to the protrusion 54*a* of the lower support unit to compress the rear end of the lower lip.

That is, the second upper lip and the lower lip are movably installed so that the lower lip moves in response to movement of the second upper lip and the distal ends of the second upper lip and the lower lip are aligned with each other.

FIGS. 6 to 8 illustrate the second upper lip 34 formed in a gradient fashion, which is another feature of the gas wiping apparatus 1 according to the first embodiment of the invention.

That is, as shown in FIG. 6, when a steel strip is coated by the continuous galvanizing line of FIG. 1, an amount of molten zinc Z' deposited on both edges (indicated with 'A') of the steel strip exceeds that of molten zinc Z deposited on a central portion thereof.

This is typically referred to as edge over coating (EOC), in which the steel strip is coated non-uniformly in the central portion and both edges thereof in a width direction. This accordingly has led to a need for preventing EOC of the steel strip.

However, conventionally, an additional auxiliary nozzle has been installed to prevent EOC of the steel strip. On the other hand, according to the invention, the gas wiping apparatus itself serves to prevent EOC.

That is, in the gas wiping apparatus 1 of the invention, the movable second upper lip 34 of the multiple upper lip 30 is disposed in a gradient fashion on the first upper lip 32 or previously manufactured in a gradient fashion.

For example, as shown in FIG. 7, exaggerated for clarity, when the second upper lip 34 is assembled on the first upper lip 32, first, a vertical bolt 60 in the center and a horizontal bolt 60' are screwed to the second upper lip 34. Then, with vertical bolts 60 in both sides loosened, the horizontal bolt 60' screwed horizontally, slantingly in fact, onto the protrusion 32*a* of the first upper lip 32 is tightened to compress both edges T of a rear end of the second upper lip 34. Next, the vertical bolts 60 in both sides are screwed to fix the second upper lip. This allows the second upper lip 34, i.e., a metal plate to be formed in a gradient fashion P in a length direction as shown in FIG. 7.

Therefore, as shown in FIG. 7, the second upper lip 34 is formed in a gradient fashion, indented only in a central portion, even if in a slight degree. Thus a gap G1 of the central portion surpasses a gap G2 of both side ends. In consequence, the high-pressure gas is ejected at a greater speed from the both side ends having a smaller gap, thereby allowing EOC portions of the steel strip to be more worn. This as a result prevents EOC of the steel strip.

Meanwhile, as shown in FIG. 8, the second upper lip 34 of the invention may be previously manufactured in a gradient fashion to be disposed on the first upper lip 32.

That is, as shown in FIG. 8, the second upper lip 34 of the invention is formed in a gradient fashion P such that both sides of a lower end thereof are more projected. Here, the both sides of the lower end of the second upper lip 34 define a gap G of a gas outlet 20 cooperatively with the lower lip.

Therefore, as shown in FIGS. 8*a* and 8*b*, the second upper lip 34 may be previously formed in a gradient fashion at the both sides of the lower end thereof according to conditions of the steel strip S1 and S2, e.g., a thickness t1 and t2 of the steel strip and coating amount (thickness).

In this case, a gap of the lower side ends is more narrowed, thereby allowing the high-pressure gas to be ejected at a higher speed. Accordingly, the molten metal, i.e., molten zinc deposited on the steel strip may be more worn by the high pressure gas.

The second upper lip 34 may be adjustably formed in a gradient fashion as described above due to its reduced size and accordingly easier movability. That is, in the gas wiping apparatus of the invention including the multiple upper lip 30, the second upper lip 34 which serves to adjust a gap of the gas outlet cooperatively with the lower lip 40 is smaller sized and thus more easily movable.

FIGS. 9 and 10 illustrate the multiple upper lip 30 of the gas wiping apparatus 1 according to a modified example of the invention. Here, the second upper lip 34 is movably installed on the first upper lip 32 of the multiple upper lip 30 by an additional compressor 70 without cumbersome bolt connections.

In a detailed description, the compressor 70 includes a fixing frame 72 and a compression plate 34. The fixing frame 72 is fixed onto the first upper lip 32. The compression plate 78 has supporting sticks 76 installed on a top surface thereof. The supporting sticks 76 are inserted into holes formed in the fixing frame, have elastic washer springs 74 joined thereto and screwed onto a top surface of the fixing frame by nuts 76, respectively. The supporting sticks 76 may be integrally provided or formed by welding or screwing. The compression plate 78 compresses the second upper lip passing through the fixing frame.

Accordingly, the elastic springs 74, as compression coil springs, generally compress the compression plate 78. In turn, the compression plate 78 compresses an upper surface of the second upper lip 34 and the second upper lip 34 is compressively fixed to the first upper lip 32.

The second upper lip 34 is inserted into an open square shape fixing frame 72 not to move left and right.

Also, the nuts 76*a* screwed onto the support sticks 76 are tightened to depart the compression plate 78 from the second upper lip 34. Correspondingly, the second upper lip 34 can move on the first upper lip. In a case where the nuts 76*a* are loosened, the compression plate is compressed by an elastic force of the strings so that the second upper lip is compressively fixed to the first upper lip.

Here, the fixing frame of the compressor 70 is preferably made of a strong material since the gas wiping apparatus has a length of about at least 2 m, which is greater than a width of a steel strip.

Although schematically illustrated, the fixing frame 72 may be bolted to a bracket welded or fixed to the first upper lip 32.

When the compressor 70 is employed, preferably, the second upper lip 34, as shown in FIGS. 8*a* and 8*b*, is premanufactured in a gradient fashion according to the standard of the steel strip and a coating amount.

Also, as shown in FIG. 10, preferably, the second upper lip 34 is provided with a seating part 89 for seating the compression plate 78 to allow the second upper lip 34 to move to the left and right more easily and be compressed more stably.

Moreover, although not illustrated, more preferably, a knurl portion is formed on an underside surface of the compression plate 78 which is in contact with an upper surface of the second upper lip. Alternatively, the compression plate itself may be used as a band steel plate.

Preferably, the compressor 70 is installed by employing a minimum number of nuts.

As a result, in the gas wiping apparatus 1 according to the first embodiment of the invention, a gap between the upper and lower lips is easily adjustable and EOC may be prevented.

FIGS. 11 to 20 illustrate a gas wiping apparatus 100 according to a second embodiment of the invention. However, the same components described in FIGS. 4 to 10 are designated with reference numerals by 10× and will not be described in greater detail.

First, as shown in FIGS. 11 to 13, the gas wiping apparatus 100 of this embodiment of the invention includes a chamber 110, a lip support unit 150 and upper and lower lips 130 and 140. The chamber 110 has a space 112 for containing a high-pressure gas and defines first and second uniform pressure spaces A1 and A2. The lip support unit 150 is associated in a front of the chamber 110 and defines a third uniform pressure space A3. The lip support unit 150 allows the high pressure gas to flow therethorugh and supports the apparatus against load. The upper and lower lips 130 and 140 are associated with a front of the lip support unit 150 to cooperatively define a gas outlet 120 with a predetermined gap.

That is, in the gas wiping apparatus 100 of this embodiment of the invention, as shown in FIG. 13, when supplied to the first uniform pressure space A1 of the chamber 110, the high-pressure gas is discharged to the second uniform pressure space A2 adjacent to the lip support unit 150 through passage holes 114 formed in a baffle wall 114. Again, the high-pressure gas flows to the third uniform pressure space A3 through the baffle wall of the lip support unit 150. Finally, the high pressure gas is ejected uniformly through the gas outlet 120 in a width direction of a steel strip so that the steel strip is coated with a uniform coating amount in a width direction thereof.

Accordingly, as shown in FIGS. 11 and 13, in the gas wiping apparatus 100 of this embodiment of the invention, the chamber 100 includes the baffle wall 114 disposed horizontally in the chamber to define the first and second uniform pressure spaces A1 and A2 as described previously.

Meanwhile, the gas wiping apparatus 100 of FIGS. 11 to 20 according to the second embodiment of the invention does not necessarily include the multiple upper lip 30 as in the gas wiping apparatus 1 of the first embodiment of the invention. However, of course, the gas wiping apparatus 100 of the second embodiment may adopt a multiple upper lip in place of the upper lip 130.

The chamber 110 is opened at one side so that the high pressure gas supplied to and contained in the inner space 112 may be ejected to the gas outlet 120.

Here, a feed pipe 116*a* connected to a side wall 116 of the chamber needs to be connected to the first uniform pressure space A1 above the baffle wall.

Therefore, as shown in FIG. 13, the high pressure gas, when supplied primarily to the first uniform pressure space A1, is contained in the chamber and then flows through the passage holes 114*a* of the baffle wall 114 of the chamber, thereby ensuring the high pressure gas to flow uniformly.

Then, the high pressure gas passes through the passage holes 114*a* of the baffle wall of the chamber and flows to the second uniform pressure space A2 in the chamber and then to a baffle wall 156 of the lip support unit 150, which will be described in greater detail later.

As shown in FIGS. 11 and 12, the baffle wall 114 of the chamber is formed by bending a metal plate. Here, a bending 114*b* may be fastened to the upper support unit 132 of the lip support unit 150, together with an upper end 112*a* of the chamber.

Meanwhile, passage holes 114*a* of the baffle wall 114 are formed integral at a pre-determined uniform interval opposite to the bending 114*b* of the metal plate in a length direction of the baffle wall 114. The passage holes 114*a* may be simply formed by bending and punching the baffle wall that is a metal plate.

The baffle wall of the chamber may be joined, at one end, to an inner wall of the chamber and, at the other end, to the lip support unit. Here, as shown in FIG. 13, preferably, the chamber of the invention may be connected by flanges.

FIGS. 11 to 13 illustrate in detail the lip support unit 150 of the gas wiping apparatus 100, which has been described with reference to FIGS. 4 to 10 and thus will be explained in no more detail.

However, the second and third uniform pressure spaces A2 and A3 are formed at both sides of the baffle wall 156 which is integrally formed between the upper and lower support units 152 and 154.

Therefore, as shown in FIG. 13, the high pressure gas, which flows from the first uniform pressure space A1 through the gas passage holes 114 of the baffle wall of the chamber, is stalled by the baffle wall 156 of the lip support unit to flow with uniform distribution, and then contained in the second uniform pressure space A2.

Next, the high pressure gas flows more uniformly to the third uniform pressure space A3 between the upper and lower lips through second gas passage holes 156*a* of the baffle wall 156 of the lip support unit. Finally, the high pressure gas is uniformly ejected through the gas outlet 120.

The lip support unit 150 of the invention serves to sustain strength of the gas wiping apparatus 100 for the reasons described above.

The upper support unit 152 of the lip support unit 150 includes a slanted support surface 152*a* to which the upper lip 130 is slantingly fixed to suppress zinc chips splashed from being deposited on a steel strip.

Also, as shown in FIGS. 11 to 13, the upper lip 130 has bolts screwed onto the slanted surface 152*a* of the upper support unit 152 of the lip support unit through slits 150*a*. Accordingly, the upper lip 130 is movable on the upper support unit corresponding to a length of the slits 34*a*, by a screwing degree of the bolts.

Here, a protrusion 152*b* is formed integral on the slanted surface of the upper support unit 152. The protrusion 152*b* has other bolts screwed thereto to compress a rear end of the upper lip 130.

Furthermore, in the same manner as the upper lip 130, the lower lip 140 of the invention has slits formed therein. The lower lip 140 is movably installed by using the bolts screwed to the lower support unit 154 of the lip support unit through the slits 140*a* and the other bolts screwed to the protrusion 154*a* of the lower support unit to compress the rear end of the lower lip.

In consequence, a gap between distal ends of the upper and lower lips forms a gas outlet 120.

Then, FIG. 14 illustrates an ejection profile P of a high-pressure gas ejected through the gas outlet 120 between the chamber 110 and the upper and lower lips 130 and 140 in a case where a feed pipe 116*a* is connected to only one side of the chamber.

That is, as shown in FIG. 14, a high-pressure gas ejection profile decreases toward a portion to which the feed pipe is connected and increases toward an opposite side of the portion. As a result, a thickness t of the steel strip S is reduced toward the opposite side of the feed pipe.

For example, increase in an ejection amount of the high-pressure gas causes the molten zinc (molten metal) to be more wiped by the gas wiping apparatus, thereby reducing a coating thickness.

Meanwhile, it has been known that the feed pipe may be connected to both sides of the chamber to eliminate differences in the high pressure gas ejection profile as shown in FIG. 18. However, since there are a difficulty of pressure control of high pressure gas and an occurrence of collision/vortex in the chamber when the feed pipe is connected to both sides of the chamber, in the present invention, only one feed pipe 116*a* is connected to the chamber to adjust differences in the high pressure gas ejection profile. This structure is not yet known.

For example, as shown in FIGS. 15 to 18, in the gas wiping apparatus 100 of the invention, the chamber 110 is provided with a profile adjuster 20 which opens and closes passage holes 114*a* formed in a baffle wall 114 of the chamber to enable the high pressure gas ejection profile to be uniform in a width direction of the steel strip.

FIGS. 15 to 18 illustrate examples 160 and 160' of the high pressure gas ejection profile adjusters installed in the gas wiping apparatus according to a second embodiment of the invention.

First, as shown in FIGS. 15 and 16, the first high pressure gas ejection profile adjuster 160 may be formed of a plate movably associated with a driver 162 installed on the baffle wall 114 of the chamber to freely open and close the passage holes 114*a* of the baffle wall in a gradient fashion in a length direction.

Moreover, the plate of the profile adjuster 160 has a front end (160*a* of FIG. 16) inclined from a portion where the feed pipe 116*a* is connected, to an opposite portion, thus providing a high pressure gas ejection profile P opposite to that of FIG. 14.

Here, the driver 162 is configured as an actuator driven by one of hydraulic pressure, air pressure and electrical power and the profile adjuster 160, i.e., the metal plate has a front end inclined and a rear end connected to a plurality of the actuators to move back and forth.

Due to a simple accessory installation of wiring, an actuator driven by electrical power may be the driver 162 according to an exemplary embodiment of the present invention.

Here, as shown in FIG. 16, with the driver 162 of the actuator operating (to move forwardly), the high pressure ejection profile adjuster 160 of the metal plate having the front end inclined allows the high pressure to be ejected less through the high pressure gas passage holes 114*a* of the baffle wall 114, in the opposite side of the portion to which the feed pipe is connected.

Therefore, the high pressure gas in the gas wiping apparatus 100 of the invention may be adjusted in its ejection amount from when passing through the baffle wall.

Then FIGS. 17 and 18 illustrate a high pressure gas ejection profile adjuster 160' of the gas wiping apparatus 100 according to another embodiment of the invention.

That is, as shown in FIGS. 17 and 18, the profile adjustor 160' of this embodiment is formed of a rectangular plate pivoted about a pivot 164 on a center of the baffle wall. Also, the profile adjustor 160 has a rear end connected to a single driver 160' and rotatable about the pivot 164'.

Here, the driver 162' as described above, may be configured as an actuator driven by one of a hydraulic pressure, an air pressure and an electrical power. The driver 162' is most preferably configured as the actuator driven by the electrical power.

Therefore, as shown in FIG. 18, since the actuator is connected to an edge of the profile adjuster 160' when the actuator is deactivated into a neutral state, the profile adjustor 160' does not open/close any of the high pressure gas passage holes 114*a*.

Also, when the actuator moves forward and backward, an area of the high pressure gas passage holes 114*a*, the area capable of being open and closed, is formed in a gradient fashion toward one of a side and an opposite side.

Therefore, in the profile adjustor 160' according to still another embodiment of the invention, when the feed pipes 116*a* are connected to both sides of the chamber and normally operates, but the high pressure gas is supplied to only one side of the feed pipes 116*a*, for example, right side, due to an error in another side of the feed pipe 116*a*, the actuator moves backward to rotate the profile adjuster 160' about the pivot 164' to an 'S' position (FIG. 18), while adjusting the high pressure gas ejection profile.

In contrast, in a case where the feed pipe 116*a* in the left side is deactivated, the driver 162', i.e., the actuator moves forward to rotate the metal plate to an 'S2' (18 of FIG. 18) position, consequently allowing the high pressure gas ejection profile to be uniform in a width direction of the steel strip.

Therefore, the high pressure gas ejection profile adjustor 160' according to this embodiment of the invention may adjust the high pressure gas ejection profile uniformly in a case where a single feed pipe is provided and also in a case where the feed pipes are connected to both sides of the chamber.

Here, as shown in FIGS. 16 and 18, preferably, the chamber provided with the profile adjuster 160 and 160' additionally includes vertical partition walls 118 vertically disposed at a predetermined interval in a length direction to allow the high pressure gas ejection profile to be uniform up to the gas outlet in a length direction.

As a result, since the gas wiping apparatus 100 includes the profile adjustor 160 or 160', the high pressure gas ejection profile may be adjusted in the chamber in accordance with conditions of connection with the feed pipe. Also, non-uniform ejection profile caused by a convergence of the high pressure gas in the chamber or the inner space of the gas wiping apparatus may be prevented by the vertical partition walls 118.

Here, as shown in FIG. 18, the actuator 162' is connected to a connecting block 166'*a* with a protrusion 166' formed thereon. The protrusion 166'*a* of the block 166' is fastened by a bolt into a slit 160'*a* formed in the profile adjuster, i.e., a metal plate. Therefore, the protrusion is slidably inserted into the slit to move in response to rotation of the profile adjuster 160'.

FIGS. 19 and 20 illustrate a modified example of a gas wiping apparatus 100 according to the second embodiment of the invention. This structure is applicable to the gas wiping apparatus 1 of the first embodiment.

For example, this structure is applicable to a gas wiping apparatus provided with a baffle wall 156 of a lip support unit 150 having a predetermined thickness.

The gas wiping apparatus of this embodiment has multistage uniform pressure spaces A1 to A3 defined by a baffle wall 114 in a chamber and a baffle wall 156 of a lip support unit 150. Moreover, the gas wiping apparatus of this embodiment arbitrarily adjusts an ejection direction of a high pressure gas flowing through passage holes 156*a* of the baffle wall of the lip support unit, thereby allowing the high pressure gas to be ejected more uniformly in a width direction of a steel strip.

For example, the passage holes 156*a* of the baffle wall 156 of the lip support unit are provided with inner diameter reduction tubes 170 for suppressing occurrence of a vortex ('V' of FIG. 19) caused by collision of the high pressure gas, thereby minimizing occurrence of the vortex of the high pressure gas flowing through the passage holes.

As shown in FIG. 20, the baffle wall 156 of the lip support unit 150 has the passage holes 156*a* formed in rows at a predetermined interval in a longitudinal direction of the baffle wall 156, and the inner diameter reduction tubes 170 inserted into the passage holes.

Therefore, as shown in FIG. 19, the high pressure gas flowing through the passage holes 156*a* of the baffle wall of the lip support unit 150 may be ejected divided along flow paths of upstream a1, middle stream a2 and downstream a3, in a third uniform pressure space A3, while bypassing a vortex area V formed by collision of the high pressure gas.

This eventually allows the high pressure gas to be ejected from the gas outlet 120 uniformly.

Each of the inner diameter reduction tubes 170, as shown in FIG. 19, may be configured as a section-bottom reduction type tube 170*a* and a section-top reduction type tube 170*b* to enable the high pressure gas to flow along paths of upstream a1 and downstream a3. Also, the passage holes 156*a* in a central portion may not need to adopt the inner diameter reduction tubes.

However, since the gas wiping apparatus is used in a high heat area, the inner diameter reduction tubes 170 may be formed of a heat resistant fire-retardant plastic material or a synthetic resin plastic material.

While the present invention has been shown and described in connection with the preferred embodiments, it will be apparent to those skilled in the art that modifications and variations can be made without departing from the spirit and scope of the invention as defined by the appended claims.

The invention claimed is:

1. A gas wiping apparatus comprising:

a chamber to which a high pressure gas is supplied, the chamber defining a multistage uniform pressure space;

a lip support unit associated with a front of the chamber to allow the high pressure gas to flow therethrough, the lip support unit supporting the apparatus against load; and upper and lower lips associated with a front of the lip support unit to cooperatively define an outlet, wherein the chamber comprises a baffle wall hermetically disposed therein in a horizontal direction extending from the lip support unit to a rear wall of the chamber and provided with passage holes for ejecting the high pressure gas uniformly to form first and second uniform pressure spaces in the chamber.

2. The apparatus according to claim 1, wherein the lip support unit comprises:

an upper support unit whose one end is connected to the upper lip and whose another end is connected to an upper end of the chamber;

a lower support unit whose one end is connected to the lower lip and whose another end is connected to a lower end of the chamber; and a baffle wall disposed integrally and vertically between the upper and lower lip support units and provided with passage holes, the baffle wall defining a third uniform pressure space between the upper and lower lips.

3. The apparatus according to claim 1, wherein the baffle wall in the chamber is formed of a plate having a bending fixed to the upper support unit of the lip support unit, and the passage holes are formed integral opposite to the bending of the plate at a predetermined interval in a length direction.

4. The apparatus according to claim 1, wherein the chamber further comprises a high pressure ejection profile adjuster movably disposed on the baffle wall to adjust an ejection profile of the high pressure gas in a width direction of a steel strip while opening and closing the passage holes of the baffle wall.

5. The apparatus according to claim 1, wherein a feed pipe is connected to at least one side of a side wall of the chamber, in a first uniform space defined by the baffle wall.

6. The apparatus according to claim 4, wherein the high pressure ejection profile adjuster comprises a plate movably associated with a driver installed on the baffle wall of the chamber to open and close the passage holes in a gradient fashion in a length direction.

7. The apparatus according to claim 6, wherein the driver is formed of an actuator driven by one of hydraulic pressure, air pressure and electrical power, and the plate of the profile adjuster has a front end inclined and a rear end connected to a plurality of the actuators to move back and forth.

8. The apparatus according to claim 4, wherein the high pressure ejection profile adjuster is formed of a plate rotatably pivoted about a center of the baffle wall and a side of a rear end of the plate is connected to a driver formed of an actuator driven by one of hydraulic pressure, air pressure and electrical power.

9. The apparatus according to claim 1, further comprising partition walls vertically installed in the second uniform pressure space of the chamber defining a multistage uniform pressure space, at a predetermined interval in a length direction to allow the high pressure ejection profile to be uniform up to the gas outlet in a length direction.

10. The apparatus according to claim 2, wherein each of the passage holes of the baffle wall includes an inner diameter reduction tube for adjusting an ejection direction of the high pressure gas, thereby reducing occurrence of a vortex of the high pressure gas flowing through the passage holes.

11. The apparatus according to claim 10, wherein the inner diameter reduction tube comprises a section-bottom reduction type tube arranged in the passage holes located in a lower part and a section-top reduction type tube arranged in the passage holes located in an upper part.

12. The apparatus according to claim 2, wherein the upper and lower lips are movably fixed to the upper and lower support units of the lip support unit by using a bolt and a slit.

13. A gas wiping apparatus comprising:

a chamber to which a high pressure gas is supplied;

a lip support unit associated with a front of the chamber to allow the high pressure gas to flow therethrough, the lip support unit supporting the apparatus against load; and, upper and lower lips associated with a front of the lip support unit to cooperatively define an outlet, wherein the upper lip comprises a first upper lip fixed to the upper support unit of the lip support unit and a second upper lip movably installed in surface contact with the first upper lip, the second upper lip defining an outlet with a predetermined gap cooperatively with the lower lip, the second upper lip is movably installed on the first upper lip by using one of a bolt, a slit and an additional compressor, and the compressor comprises a fixing frame fixed onto the first upper lip and a compression plate comprising a supporting stick installed on a top surface thereof, the supporting stick inserted into a hole formed in the fixing frame, having an elastic spring joined thereto and screwed onto a top surface of the fixing frame by a nut, the compression plate compressing the second upper lip passing through the fixing frame.

14. The apparatus according to claim 13, wherein the second upper lip is integrally provided with the slit through which a vertical bolt is screwed to the first upper lip, and the first upper lip is integrally provided with a protrusion to which a horizontal bolt is screwed to compressively support a rear end of the second upper lip.

15. The apparatus according to claim 13, wherein the second upper lip is installed on the first upper lip in a gradient fashion in a length direction, or previously manufactured in a gradient fashion to be installed on the first upper lip in order to prevent edge over coating of the steel strip.

16. The apparatus according to claim 15, wherein a rear side of the second upper lip is compressed by horizontal bolts in both sides while the second upper lip is fixed to the first upper lip by a vertical bolt in a central portion to narrow a gap between the lower lips in a gradient fashion toward both side ends.

17. The apparatus according to claim 15, wherein a plurality of the second upper lips are previously manufactured to narrow a gap between the lower lips in a gradient fashion toward both side ends and selectively installed in accordance with conditions of the steel strip and a coating amount.

* * * * *